United States Patent [19]

Steenson et al.

[11] 4,271,737

[45] Jun. 9, 1981

[54] MOVABLE INSULATION PUNCHER

[75] Inventors: Thomas W. Steenson, Richmond Hill; W. Donald Paton, Aurora, both of Canada

[73] Assignee: Butler Manufacturing Company, Kansas City, Mo.

[21] Appl. No.: 70,784

[22] Filed: Aug. 29, 1979

[51] Int. Cl.[3] ..... B26F 3/08

[52] U.S. Cl. ..... 83/171; 83/588; 83/620; 83/928

[58] Field of Search ..... 83/15, 16, 171, 588, 83/599, 633, 620, 928; 228/51, 58, 901, 902

[56] References Cited

U.S. PATENT DOCUMENTS

| | | | |
|---|---|---|---|
| 722,452 | 3/1903 | Mossner | 83/588 |
| 1,295,750 | 2/1919 | Hibbs | 228/51 |
| 1,876,574 | 9/1932 | Anderson | 83/171 |
| 1,884,398 | 10/1932 | Uxley | 83/633 |
| 2,445,093 | 7/1948 | Von Cseh | 83/633 |
| 4,028,974 | 6/1977 | Collet | 83/171 |
| 4,119,137 | 10/1978 | Eberle | 228/901 |

*Primary Examiner*—Frank T. Yost
*Assistant Examiner*—K. Bradford Adolphson
*Attorney, Agent, or Firm*—Shoemaker and Mattare, Ltd.

[57] ABSTRACT

A movable insulation puncher includes lancing elements which are used to define slots for receiving shear connectors in a multi-layer panel. The lancing elements are heated by gas burners and are moved along a panel on a carriage, and toward a panel by a crank assembly. Return to a neutral position of the lancing elements is spring assisted, and the carriage can be used to store tools, or to support a workman.

8 Claims, 8 Drawing Figures

MOVABLE INSULATION PUNCHER

BACKGROUND OF THE INVENTION

The present invention relates in general to building panels, and, more particularly, to means for punching composite building panels.

A reinforced insulated concrete building panel is disclosed in U.S. Pat. No. 4,117,639. This panel has a plurality of layers, including a layer of insulation sandwiched between inner and outer layers of concrete. Shear connectors are embedded in the panel to prevent delamination of the panel.

These shear connectors are U-shaped and have bent lowermost ends which extend at approximately right angles to the axes of the legs. The lowermost ends help to securely set the shear connector in the panel.

The shear connector should be placed in an easy manner, and in a manner which reduces the possibility of mistakes and neatly places the shear connectors while avoiding a possibility of damaging the insulation. Heretofore, placing these shear connectors has been extremely difficult in some of the thick and/or heavy density materials.

There are known methods of placing shear connectors. For example, in early panels shear connectors of various types were installed at the joints between sheets of insulation. However, this method requires that a space be defined between the insulation layers. Furthermore, using such a method, the insulation joints were required to be in a special pattern to suit the spacing of the shear connectors.

Another known method of setting shear connectors includes merely pushing the shear connectors through the insulation as required. While this method may be satisfactory on soft insulations, it is not satisfactory on the better class and heavier density insulation for a number of reasons. These reasons include: (1) It is very difficult to push a shear connector through even two inch thick insulation. Furthermore, due to the density of the insulation, there is a tendency for a large piece of insulation to break off as the shear connector is pushed through. (2) If insulation breaks off, a broken piece may be pushed into the wet concrete below and leave a void in the insulation. Such a void affects the thermal performance of the finished product.

Pre-punching insulation at the factory to a predetermined grid may be another way to solve the above problems. However, pre-punching insulation is not practical for the following reasons: (1) The spacing or grid can change from day to day or even in the same cast of panels, as the spacing changes according to the length of the panels. (2) The spacing of the shear connectors is different at the top and bottom of the panels for structural reasons. (3) Special sheets of insulation may be required to complete the length of each panel.

Accordingly, there is need for a device which sets shear connectors, especially shear connectors such as disclosed in U.S. Pat. No. 4,117,639, in an easy, accurate manner without damaging the insulation or endangering the shear connector or the thermal performance of the panel.

SUMMARY OF THE INVENTION

The punching unit embodying the teachings of the present invention sets shear connectors in multi-layer panels such as that panel disclosed in U.S. Pat. No. 4,117,639, which disclosure is incorporated herein by reference thereto.

The preferred form of the unit disclosed herein includes a plurality of burners mounted on a movable wagon. The burners produce a needle-point flame which is directed into a blind-ended bore of a special element mounted on each of the burners. The lowermost end of the special element is used to lance the panel and define a slot into which a shear connector is placed. Accordingly, the lowermost end of the lancing element is sized and shaped to define a hole which will properly accommodate a shear connector, especially a shear connector such as disclosed in the referenced patent.

The burners and the plumbing associated therewith are mounted on the special carriage by a beam. The beam is movable so that the lancing elements can be advanced into contact with the panel, then retracted so the panel can be moved, or the carriage moved, whichever is suitable. Manual levers on each side of the carriage are used to move the beam. A spring loaded counterbalance system assists in the return movement of the beam.

The carriage moves on the tracks located adjacent the panel. A gauge is mounted on the carriage to set the spacing between the shear connector holes in the panel.

The unit disclosed herein streamlines the placing of shear connectors in any insulation material. The unit is easy to use, eliminates costly errors, makes a neat job of placing shear connectors and avoids damaging the insulation during the operation.

The unit disclosed herein is mobile, has means for raising and lowering the gas burner hole forming elements, is lightweight and runs along the top of side rails. The unit is manually operated to gang punch shear connector holes, in the preferred embodiment, twelve at a time for 8 foot panels, and six at a time for 4 foot panels. The protrusion tips of the lancing elements are heated by propane gas and the whole mechanism, which is mounted on a spring loaded beam, is manually activated to punch the holes. The lateral spacing of the holes is fixed, and the longitudinal spacing is controlled by a gauge set to appropriate spacing, for example, 2 feet, 2 feet-6 inches, or 3 feet.

As an added feature, a deck or bridge of the unit can be used to transport hardware along the bed, or as a work platform for finishing special panels.

OBJECTS OF THE INVENTION

Accordingly, it is a main object of the present invention to provide a method of punching holes in insulation of a multi-layer panel to a grid determined by the length of the panel.

It is another object of the present invention to provide a method of marking the position of shear connectors accurately in both horizontal and longitudinal locations of the multi-layer panel.

It is still a further object of the present invention to use a wagon on which a puncher is mounted as a means of transporting shear connectors, hardware and the like along the casting bed of a panel forming operation during production.

It is yet another object of the present invention to use a wagon as a bridge for finishing special cutouts, window openings, or the like, during production.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 8:
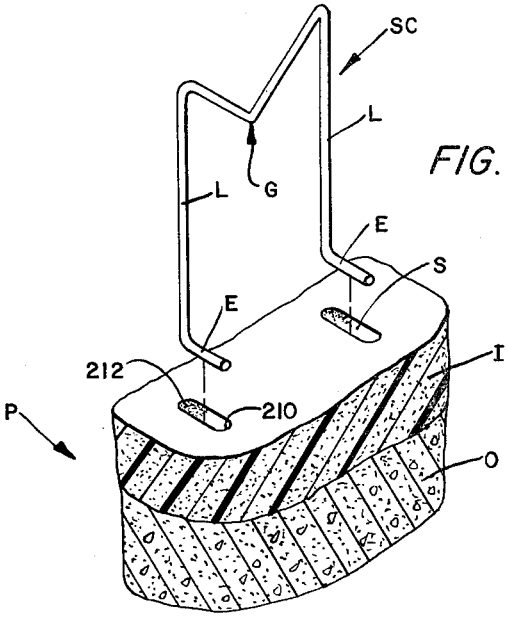
FIG. 8 is a perspective view of a shear connector and a multi-layer panel which are used in conjunction with the punching unit embodying the teachings of the present invention.

Shown in FIG. 8 is a composite panel P formed of an insulation layer I and another layer O which can be concrete or the like. U.S. Pat. No. 4,117,639 contains a full disclosure of such a panel, and attention is directed thereto. A shear connector SC is embedded in the panel to prevent delamination of the panel. The shear connector SC is also fully described in the referenced patent, and includes a pair of legs L having rearwardly bent lower ends E and a depth gauge G on the outer end thereof. The legs of the connector are received in slots S defined in the panel. The depth gauge sets the depth to which the connector is inserted into the panel.

The slots S are defined in rows extending transversely across a panel being formed. By referring to FIG. 1, it is seen that the slots are defined in rows R which are spaced apart by a distance LR along the longitudinal centerline of the panel. The panel P is formed in a continuous process and has longitudinal side edges SE.

As will be discussed below, the slots S in any particular row are defined at appropriate spacings to properly receive the shear connectors, and the rows are spaced apart suitable distances.

Figure 1:
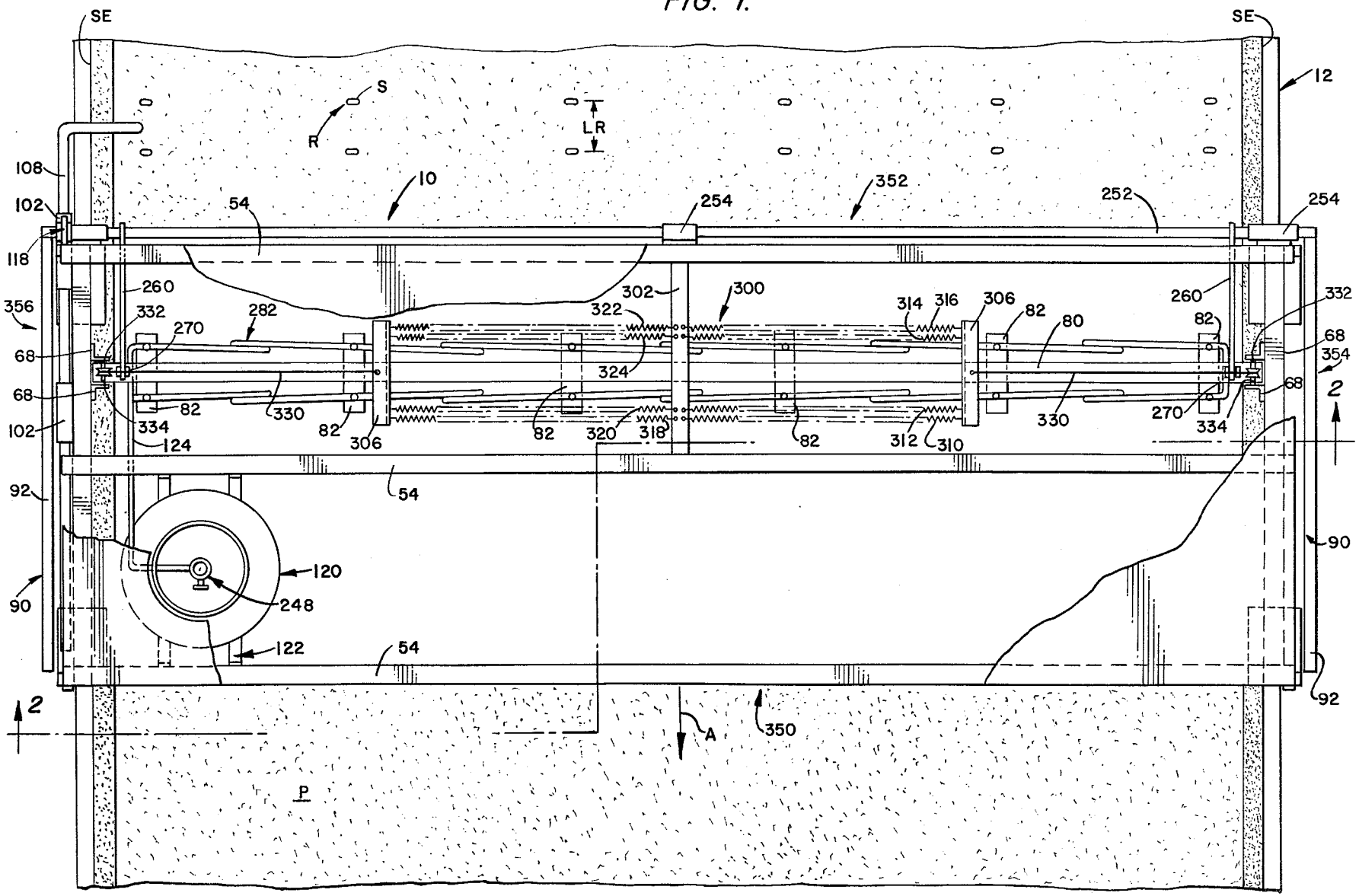
FIG. 1 is a plan view of a punching unit embodying the teachings of the present invention.
Figure 2:
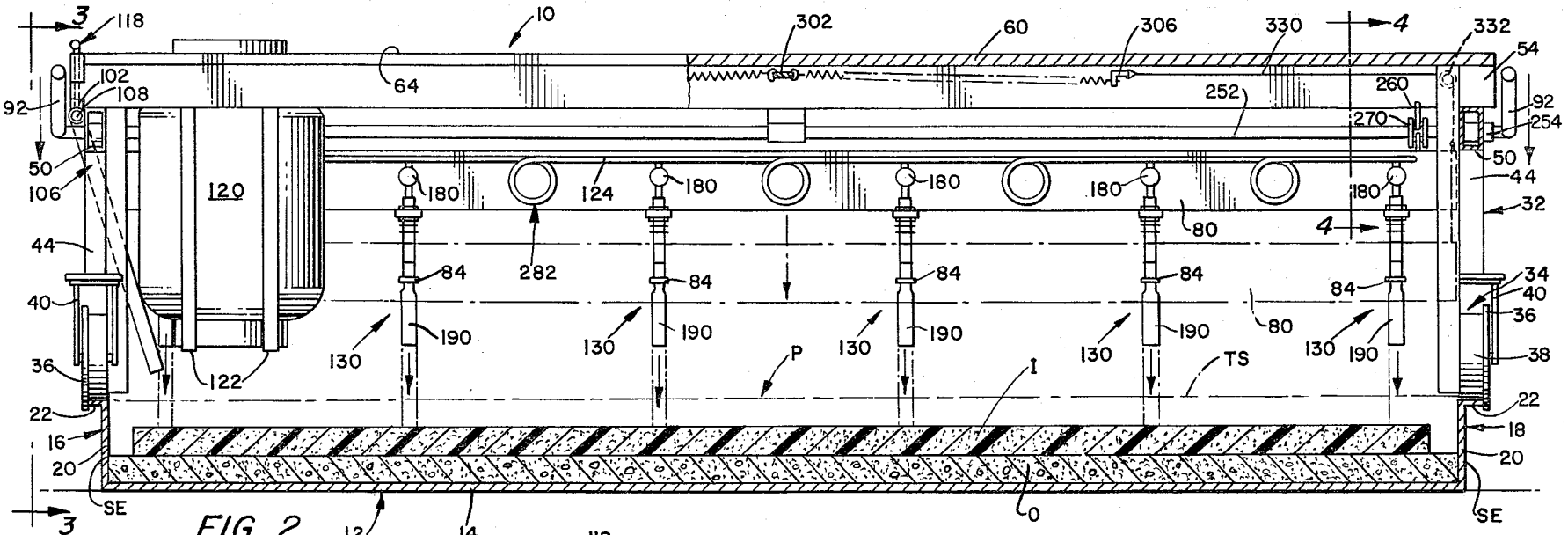
FIG. 2 is an end elevation view of the punching unit embodying the teachings of the present invention.
Figure 3:
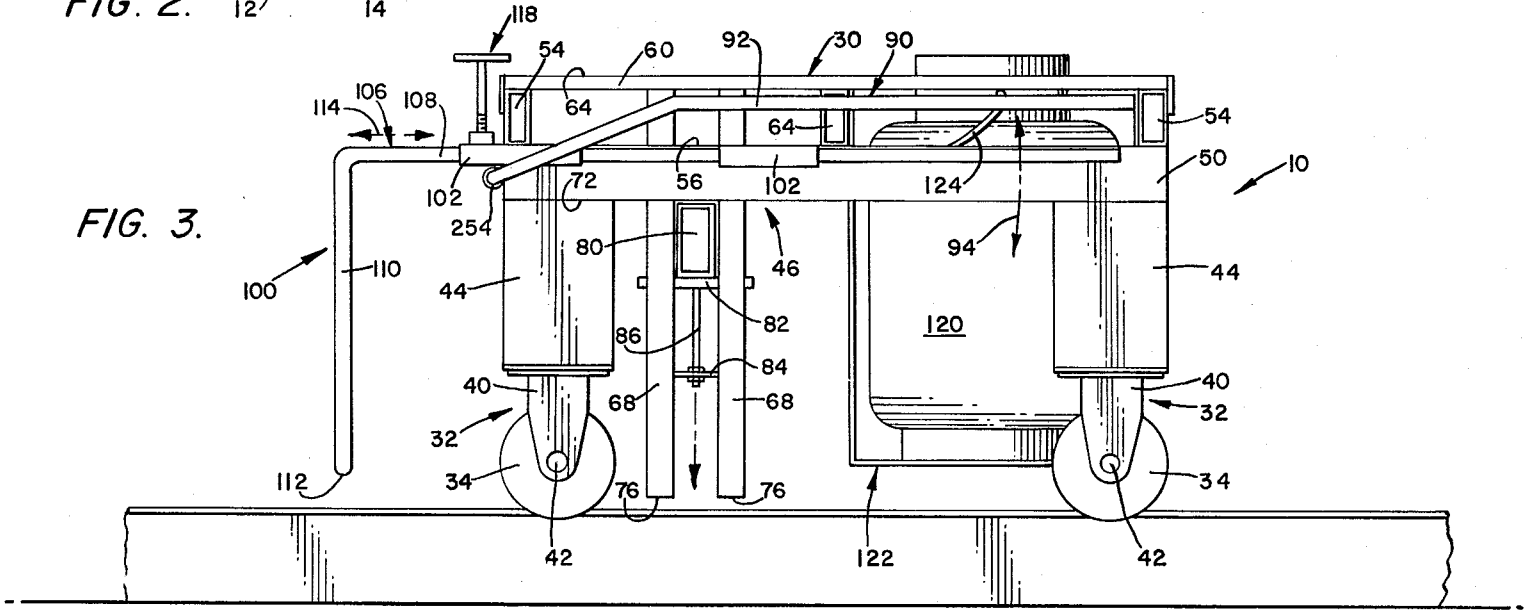
FIG. 3 is a view taken along line 3—3 of FIG. 2.

An insulation punching unit 10 is shown in FIGS. 1, 2, and 3, and attention is directed thereto. As shown in FIGS. 1 and 2, the panel P has a track-defining bracket 12 surrounding same on three sides thereof. The bracket 12 has a web 14 supporting the panel P and a pair of side flanges 16 and 18 integrally attached thereto to extend in spaced parallelism with each other and each located closely adjacent the panel side edges SE. The flanges 16 and 18 each includes a vertical base 20 and a horizontal lip 22 located to be essentially coplanar with top surfaces TS of the panel P. The top flanges 22 extend outwardly of the panel as shown in FIG. 2.

As best shown in FIG. 3, the unit 10 includes a wagon or carriage 30 having a plurality of bogies 32, preferably four, supporting same. Each bogie includes a wheel 34 having a flange 36 on one face thereof and a supporting wheel section 38 mounted on the flange 22. The flange 36 maintains the wheel 34 on the trackway defined by the track 16 or 18. Each wheel is rotatably mounted on a wheel mount 40 by an axle 42, with the wheel mount being located on the inside of the trackway, that is, on the side of the wheel section 38 opposite the flange 36.

Each wheel mount is supported on a leg 44 which extends upwardly from the top of the wheel mount, and is connected at a top end thereof to a wagon bed section 46 which extends along and across the tracks.

The bed section includes a pair of base beams 50 mounted on the legs 44 to be essentially horizontally disposed. A plurality of purlin-like beams 54 extend transversely across the trackway and are mounted on base beam upper surfaces 56 to extend upwardly therefrom. A bridge forming beam 60 is mounted on top of the purlins and has an upper surface 64 thereon.

A pair of guide beams 68 are essentially vertically disposed and connected at the top ends thereof to undersurface 72 of the beam 50 to depend downwardly therefrom. The guide beams 68 have lower ends 74 and 76 spaced above the trackway, and the beams are in spaced parallelism with each other. As shown in FIG. 1, the guide beams are L-shaped brackets. A movable mounting beam 80 is mounted between the guide beams by a cross-brace 82, and a mounting plate 84 is connected to the cross-brace by a connecting bar 86 to be movable therewith in a vertical direction toward and away from the panel P. The function and operation of the movable beam and movable plates will be discussed below. The cross-brace 82 has appropriate channels or the like defined therein which are coupled to the guides 68 to support that brace on those guides in a movable manner.

A crank mechanism 90 is located on each side of the carriage and is mechanically linked to the beam 80 to move that beam. Each track mechanism includes a crank arm 92 mechanically linked at one end to the beam 80 and free at the other end to move in the direction indicated by arrow 94 in FIG. 3.

A slot locating gauge mechanism 100 is mounted on the carriage and includes a plurality of tubular mounts 102 mounted on one of the beams 50 to have the central axes thereof extending along the trackway, and a gauge bar 106 slidably mounted in the brackets 102. The bar 106 is L-shaped and has one leg 108 received in the mounts and the other leg 110 vertically oriented with the lower end 112 thereof located closely adjacent the panel top surface. The gauge bar is movable in the direction indicated by arrow 114 in FIG. 3, and is used to set the spacing LR shown in FIG. 1. A T-shaped set screw mechanism 118 is used to hold the bar 106 in the selected position.

The unit 10 includes a fuel system, which preferably includes a propane tank 120 mounted on the carriage by a bridle mechanism 122, and has a fuel line 124 connected at one end thereof to the tank. The fuel system will be further discussed below.

As shown in FIG. 2, unit 10 includes a plurality of panel lancing elements 130. Each lancing element 130 defines a slot S in the panel, and these lancing elements are thus spaced accordingly. The lancing elements will be explained with reference to FIGS. 4, 5 and 6. Each lancing element is mounted on the mounting plate 84 which extends transversely across the panel on the wagon. Each element includes a stepped coupling 132 which has a neck section 134 defined therein and which is jam fit into a hole 136 defined in the mounting plate 84. The coupling 132 has a large section 138 located above the plate 84, and a small section 140 located below the plate 84 with the neck section extending through the plate. A plurality of spiracles 146 and 148 are defined in the section 138.

Figure 5:
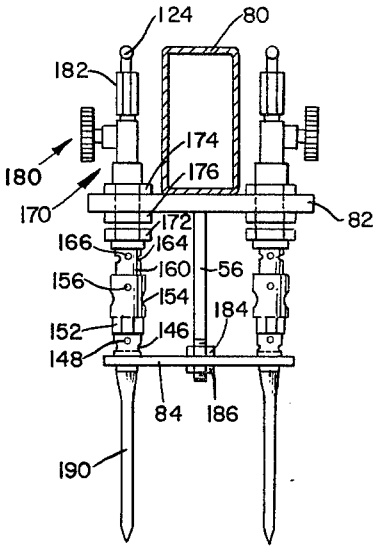
FIG. 5 is an elevation view of a pair of lancing elements used in the punching unit embodying the teachings of the present invention.
Figure 6:
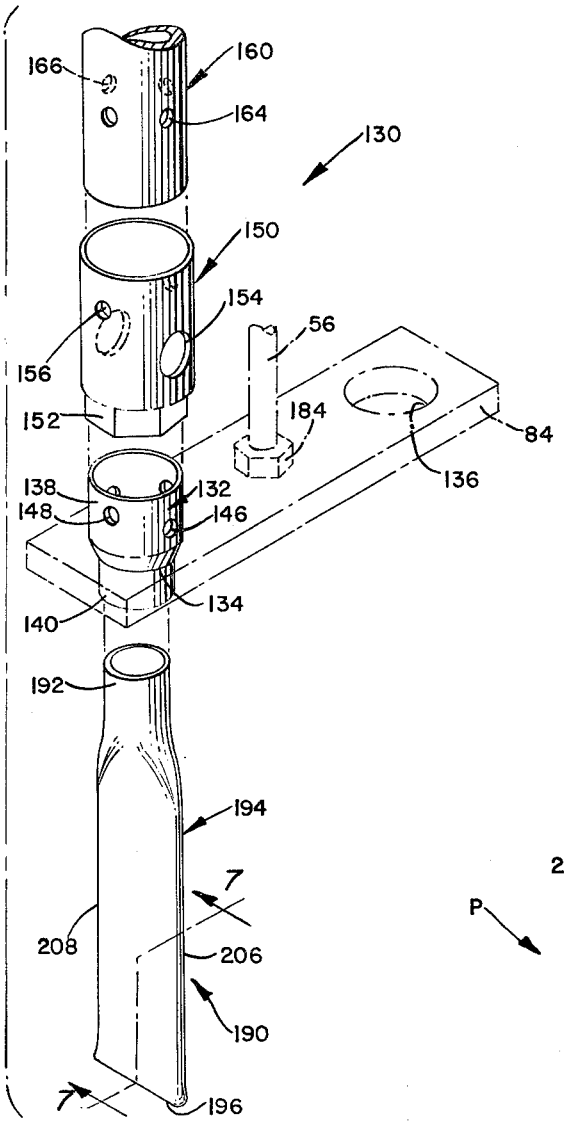
FIG. 6 is an exploded perspective of a lancing element used in the punching unit embodying the teachings of the present invention.

A thrust coupling 150 is tubular and includes a plurality of flats 152 on the lower end thereof and a plurality of air circulation holes 154 and 156 defined therein. The coupling 150 is friction fit onto the coupling 132 so that the flats are located on the outside of the coupling 132 as shown in FIG. 5. A burner has a burner nozzle 160 which is tubular and is jammed into the coupling 150 as indicated in FIG. 6. The nozzle 160 has a plurality of air circulation holes 164 and 166 defined therein to have the holes 164 aligned with the holes 154 of the coupling 150. The holes 166 provide proper air circulation and aspiration for the burner assembly of which the nozzle 160 is part.

The burner assembly 170 includes a burner, preferably a propane burner, mounted by a mounting nut 172 to the nozzle section 160. A pair of jam nuts 174 and 176 mount the burner assembly 170 to the beam 82, and a gas control valve 180 controls the amount of gas applied to the burner, thereby controlling the heat output of the burner assembly. The fuel line 124 is shown in FIG. 5 to be connected to the top of the assembly with the valve 180 located to control gas flow from the fuel line. A coupling sleeve 182 can be used to couple the fuel line to the burner assembly.

As shown in FIGS. 5 and 6, nuts 184 and 186 are mounted on the lower end of each connecting bar 56 to adjustably attach that bar to the mounting plate 84.

Figure 7:
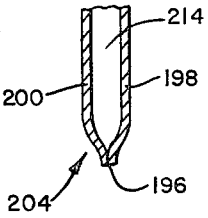
FIG. 7 is an elevation view of a piercing point of a lancing element used in the punching unit embodying the teachings of the present invention.

A hollow lancing tip 190 is mounted on the lower end of the coupling 132 as shown in FIG. 6. The lancing tip has a circular neck 192 jam fit onto the lower end of the coupling 132 and extending downwardly therefrom beneath the mounting plate 84. The lancing tip 190 has a flattened body portion 194 and a sealed tip 196 located at the lowermost end of the tip 190. The sealed tip is best shown in FIG. 7, and is formed by sealing planar walls 198 and 200 of the flattened section together at the lower terminal ends thereof. A downwardly pointing piercing point 204 is thus defined by the sealed tip. The width of the body portion as measured between longitudinal side edges 206 and 208 thereof corresponds to the length of the slot S as measured between arcuate ends 210 and 212 thereof. The sealed end and the hollow nature of the lancing tip thus defines a blind-ended bore 214 within each lancing tip element.

As can be seen from FIGS. 5–7, the burner assembly 170 produces a flame which is preferably needle-point, and which is downwardly directed toward the panel P within the bore 214. The flame is encased and confined within the couplings and the lancing tip 190. The heat generated by the flame heats the lancing tip to a desired temperature. The desired temperature is determined by considerations involved in melting insulation I to define therein slots S without burning or otherwise damaging that insulation. The gas fuel, fuel feed, burner specifications, assembly materials and the like are selected to accomplish the defining of the slots S without undue damage to the rest of the panel. Those skilled in the art will be able to determine proper operating parameters from the teachings of this disclosure. Fuel feed can be controlled by a regulator mechanism 248 on the tank 120, as shown in FIG. 1.

The lancing elements are engaged against the panel to define the slots S. At other times, the lancing elements are spaced from the panel. A lance moving mechanism 250 is used to move the lancing elements toward and away from the panel. The lance moving mechanism includes the crank mechanism 90 and a rocking bar 252 mounted on the beam 50 to be rotatable about the longitudinal centerline of that rocking bar. Tubular mounts 254 mount the bar 252, and the bar 252 extends completely across the carriage 12 as best shown in FIG. 1. As shown in FIG. 5, one end of the crank 92 is attached to the rocking bar 252 to rotate that bar about the longitudinal centerline thereof when the crank is moved in the direction indicated by the arrow 94 in FIG. 3.

A pair of pitman arms 260 are each connected at one end thereof to the bar 252 for rotation therewith. As shown in FIG. 5, each pitman arm is bent to have a long section 264 and a short section 266 with the long section being connected to the bar 252. A crank element 270 is connected at one end to the pitman short section and at the other end to a lug 272 attached to the top of the beam 80.

Figure 4:
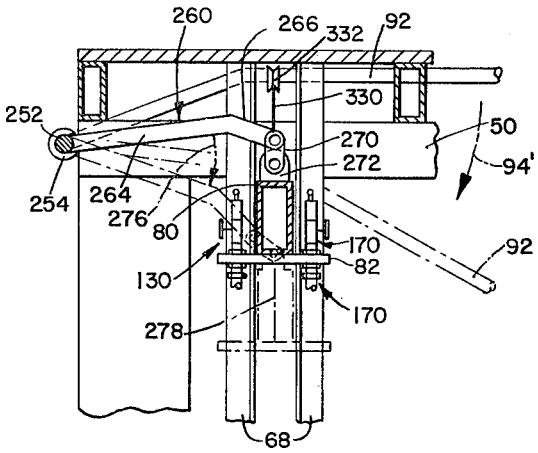
FIG. 4 is a view showing a beam moving means used in the punching unit embodying the teachings of the present invention.

Rotation of the crank arm 92 in the direction of arrow 94' in FIG. 4 moves the pitman arm 260 in the direction of arrow 276 from the position thereof shown in solid lines to the position thereof shown in phantom lines. The guide beams and the crank 270 cause the lance mounting means to move vertically in the direction indicated by arrow 278 from the position shown thereof in solid lines to the position thereof shown in phantom lines in FIG. 4. Downward movement of the lance mounting means is gravity assisted, and causes the lancing tip of the lances to contact the panel to thereby define slots S in that panel.

As shown in FIGS. 1 and 2, the fuel line 124 has loops 282 defined therein adjacent each lancing assembly. The loops flex and unflex as the lancing elements are moved to prevent damage to the fuel line 124 during such movements.

A beam return mechanism 300 is best shown in FIGS. 1, 2 and 4. As shown in FIG. 1, the return mechanism 300 includes a fixed spring mounting bar 302 located centrally of the bridge 60 and extending lengthwise of the panel. The mounting bar 302 is preferably affixed at the ends thereof to the beams 54. A plurality of spring mounting plates 306 are spaced from each other and from the bar 302. In the FIG. 1 embodiment, there are two plates 306, one on each side of the centrally located mounting bar 302.

A plurality of springs 310 through 324 are each connected at one end thereof to the bar 302 and at the other end thereof to one of the plates 306. The spring lengths and spring constants are selected and adjusted so that downward movement of the lancing elements causes extension of the springs so that the springs assist the upward movement of the lancing elements when the cranks 92 are released, or moved upwardly.

As shown in FIGS. 1, 2 and 4, a pair of guide cables 330 are each attached at one end thereof to a mounting plate 306 and at the other end thereof to the beam 80 at or near one end of the beam. Each cable is trained around a sheave 332 mounted on a shaft 334 which is mounted on the legs of the carriage. The cables 330 connect the springs to the beam 80 and can also be used to adjust the position of the plates 306 with respect to each other and with respect to the bar 302 to thereby adjust the spring length and tension of the springs 310 through 324. A cable length adjusting means such as a turnbuckle, or the like, (not shown) would be used in such a case.

As shown in FIGS. 1 and 5, the lancing elements are provided in pairs with all lance piercing points being essentially coplanar with each other.

A preferred embodiment of the present invention includes twelve propane gas burners with a rating of 2500 BTUs each. The lancing elements are mounted in pairs on beam 80 which is a 4 inch by 2 inch by 8 foot hollow metal tube.

The lance coupling 150 is fabricated from a $\frac{5}{8}$ inch ID copper pipe, the lance tip circular section 192 has an OD of $\frac{3}{8}$ inch and is copper. The $\frac{3}{8}$ inch copper pipe of the lancing element 190 is pressed together until it is approximately $\frac{1}{4}$ inch wide. The lowermost end of the lancing element tip is sealed together. The holes 156, 164 and 166 are $\frac{1}{8}$ inch and the holes 154 are $\frac{3}{8}$ inch for proper air circulation. The element is pushed over the outside of the gas burner and is held in position with a bolt which is welded to the hollow metal tube.

The correct pressure on the gauge 248 is approximately 25 psi which ensures that the temperature is at a minimum of 500° F. at the piercing point end of the copper element. The temperature must be controlled between 500° F. and 600° F. If the temperature is less than 500° F., it will be difficult to push the lancing points through the insulation. If the temperature is more than 600° F., the heat will reach the insulation before the element is inserted, and will punch an oversized hole. The size of each slot is approximately $\frac{1}{2}$ inch by $\frac{1}{4}$ inch, but such size can vary depending on the shape of the extension.

In one embodiment, wagon 12 has four wheels, and the wagon and lancing elements are fabricated to punch insulation up to 4 inches thick. However, by replacing the protrusion tips with longer ones, insulation thicker than 4 inches can be punched.

The unit 10 is thus very mobile, and the spring mechanism assists the raising of the lancing elements to a neutral position.

The carriage bridge 60 can be used to store tools, or the like, and can be used to support a workman should the need arise.

Operation of the unit 10 is evident from the above description, and will thus be described only briefly. The spacing gauge 106 is set, and the tank regulator 248 set. The burners are ignited, and the unit is advanced in the direction indicated by arrow A in FIG. 1. Thus, for the direction indicated in FIG. 1, the carriage includes fore end 350, aft end 352, port side 354 and starboard side 356. The gauge 106 extends outwardly from the aft end and is used to define spacing L. Workmen are positioned on the starboard and port side and operate the cranks 92 whenever a row of slots S is to be defined. The spacing between slots in a particular row is set by the spacing between lancing elements, and the spacing between rows of slots is set according to the gauge mechanism.

The unit can be moved by hand, or can have a carriage drive to move that carriage forward along the tracks.

Upon depression of the cranks, the springs 310 through 324 are extended as the beam 80 moves downwardly. The cranks 92 are moved far enough to contact the piercing tips 204 with the insulation of the panel. Further rotation of the cranks causes the hot lancing tips to penetrate the insulation to define a row of slots S.

After the slots are defined, the cranks 92 are rotated in the opposite direction, and the beam 80 is raised upwardly. This upward movement of the beam 80 is assisted by the springs 310 through 324 returning to the relaxed position.

The unit is advanced with respect to the panel until all of the slots in an array have been defined.

Should adjustments be necessary, or repairs to the panel necessary, or windows or other openings be necessary in the panel, or the like, a workman can walk out to the appropriate location on the bridge 60. Tools, or the like, can also be supported on the bridge 60 if so desired.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A movable insulation puncher comprising:

a multi-layer panel having a layer of insulation;

a track-defining bracket surrounding said panel and including a web supporting said panel and a pair of side flanges attached to said web to be located closely adjacent the side edges of said panel, said side flanges forming tracks;

a carriage which includes wheels adapted to move along said tracks, a base beam mounted on said wheels, a bridge extending across said multi-layer panel, and a fuel tank mounted on said carriage;

insulation lacing means on said carriage, said lancing means including guide means on said carriage, a support beam movably mounted on said guide means, a mounting plate mounted on said support beam to be movable therewith, a plurality of hollow insulation lancing tip means mounted on said plate, said lancing tip means each having an elongate flattened body portion which includes a pair of planar walls, said planar walls including lower edges, said lancing means further including a lancing tip which includes said planar wall lower edges, said lancing means each having a blind ended bore defined therein, a burner connected to each lancing tip means, each burner having means defining a needle-shaped flame to heat the lancing tip means associated therewith to a temperature sufficient to define a hole in said layer of insulation, each burner being connected to said tank to receive fuel therefrom;

lancing tip means moving means mounted on said carriage and including a crank movably mounted on said carriage, mechanical means connecting said crank to said support beam for moving said support beam in conjunction with said crank; and beam return means connecting said movable beam to said carriage to assist a return movement of said movable beam against gravity.

2. The movable insulation puncher defined in claim 1 wherein said lancing means further includes a first coupling connecting said lancing tip to said mounting plate, a second coupling means connecting said first coupling means to said burner.

3. The movable insulation puncher defined in claim 1 wherein said lancing means moving means includes a rocking bar rotatably mounted on said base beam, a pitman arm connected to said rocking bar to move therewith, said crank connecting said pitman to said movable support beam.

4. The movable insulation puncher defined in claim 1 wherein said beam return means includes a plurality of springs, spring mounting means connected to said springs, and cable means connecting said spring mounting means to said movable support beam.

5. The movable insulation puncher defined in claim 1 further including a flexible fuel line connecting said fuel tank to said burners, said fuel line including a plurality of loops.

6. The movable insulation puncher defined in claim 1 further including a gauge means mounted on said carriage for gauging distance between adjacent shear connector receiving slots.

7. The movable insulation puncher defined in claim 6 wherein said gauge means includes an L-shaped bar mounted on said carriage.

8. The movable insulation puncher defined in claim 1 wherein said bridge is mounted securely enough to support tools and workmen.

* * * * *